US011739528B1

(12) United States Patent
Lara

(10) Patent No.: US 11,739,528 B1
(45) Date of Patent: Aug. 29, 2023

(54) ROOFING SYSTEM

(71) Applicant: Jesus Lara, Stuart, FL (US)

(72) Inventor: Jesus Lara, Stuart, FL (US)

( * ) Notice: Subject to any disclaimer, the term of this patent is extended or adjusted under 35 U.S.C. 154(b) by 0 days.

(21) Appl. No.: 17/683,795

(22) Filed: Mar. 1, 2022

(51) Int. Cl.
*E04D 3/36* (2006.01)

(52) U.S. Cl.
CPC ..... *E04D 3/3608* (2013.01); *E04D 3/3605* (2013.01)

(58) Field of Classification Search
CPC ... E04D 3/3605; E04D 3/3608; E04D 13/165; E04D 13/1681
See application file for complete search history.

(56) References Cited

U.S. PATENT DOCUMENTS 4,314,428 A * 2/1982 Bromwell ..... E04D 13/165 52/404.3
4,445,305 A * 5/1984 Orie, Sr. ..... E04G 23/02 52/407.3
4,494,343 A * 1/1985 Berry ..... E04D 3/3608 52/410
4,503,653 A * 3/1985 Simpson ..... F16B 35/06 52/693
4,528,789 A * 7/1985 Simpson ..... E04C 3/08 52/404.3
4,620,397 A * 11/1986 Simpson ..... E04C 3/08 52/90.2
4,691,491 A * 9/1987 Lilley ..... E04D 3/3602 52/712
5,005,323 A * 4/1991 Simpson ..... E04D 3/362 52/90.2
5,287,670 A * 2/1994 Funaki ..... E04D 3/3608 52/520
5,303,528 A * 4/1994 Simpson ..... E04D 3/364 52/645
5,367,848 A * 11/1994 McConnohie ..... E04D 3/3608 52/336
5,402,572 A * 4/1995 Schulte ..... E04G 23/02 29/402.09
5,600,971 A * 2/1997 Suk ..... E04D 3/3608 52/537
5,704,170 A * 1/1998 Simpson ..... E04D 3/363 52/645
5,743,063 A * 4/1998 Boozer ..... E04B 7/00 52/749.12

(Continued)

*Primary Examiner* — James M Ference
(74) *Attorney, Agent, or Firm* — Gulf Coast Intellectual Property Group

(57) ABSTRACT

A roofing system that is configured to be superposed upon an existing roof and further be mechanically coupled to the purlins of the structure on which the roofing system is being installed. The present invention includes a plurality of support spacing members wherein the support spacing members are axially aligned with purlins of the structure and mechanically secured thereto. The support spacing members include a center portion that is elevated with respect to the existing roof. A plurality of roof panel members are provided wherein the roof panel members further include longitudinal edge formations. The longitudinal edge formations of the roof panel are configured to couple with longitudinal clip members in order to operably couple adjacent roof panel members during installation of the roofing system of the present invention. The longitudinal clip members are mateably shaped to facilitate coupling with the roof panel members.

8 Claims, 6 Drawing Sheets

(56) References Cited

U.S. PATENT DOCUMENTS 5,855,101 A * 1/1999 Schulte ..... E04D 3/3608 52/537
5,875,592 A * 3/1999 Allman ..... E04D 3/3608 52/90.2
6,354,045 B1 * 3/2002 Boone ..... E04D 3/3608 52/95
7,174,686 B1 * 2/2007 Legband ..... E04D 3/3608 52/471
7,861,480 B2 * 1/2011 Wendelburg ..... E04C 3/07 52/783.17
8,024,906 B1 * 9/2011 Nelson ..... E04D 13/165 52/410
8,061,087 B2 * 11/2011 Ray ..... E04G 23/0281 52/90.2
8,327,590 B2 * 12/2012 Ray ..... E04G 23/0281 52/90.2
8,371,083 B2 * 2/2013 Chamberlin ..... E04D 13/1681 52/404.3
8,938,924 B1 * 1/2015 Smith, Jr. ..... E04D 3/362 52/395
9,027,286 B2 * 5/2015 Lane ..... E04D 3/365 52/90.2
10,030,392 B2 * 7/2018 Lane ..... E04D 11/005
10,815,657 B2 * 10/2020 Hortom ..... E04D 3/3608
2006/0037280 A1 * 2/2006 Smith ..... E04D 3/40 52/747.1
2008/0163573 A1 * 7/2008 Wendelburg ..... E04C 3/07 52/262
2009/0094926 A1 * 4/2009 Richmond ..... E04F 13/12 52/550
2009/0211177 A1 * 8/2009 Grafton ..... E04D 3/3608 248/237
2010/0275525 A1 * 11/2010 Wendelburg ..... E04D 13/1681 52/90.2
2011/0016803 A1 * 1/2011 Ray ..... E04G 23/0281 52/302.1
2012/0042597 A1 * 2/2012 Ray ..... E04D 3/3608 248/237
2012/0079775 A1 * 4/2012 Chamberlin ..... E04D 13/165 52/698
2012/0279165 A1 * 11/2012 Marshall ..... E04D 13/1643 52/655.1
2013/0139468 A1 * 6/2013 Poivet ..... H02S 20/23 52/741.1
2015/0292209 A1 * 10/2015 Kralic ..... E04D 1/36 52/716.2
2018/0073242 A1 * 3/2018 Hortom ..... E04D 3/3608
2018/0112411 A1 * 4/2018 Lane ..... E04D 11/005
2021/0062510 A1 * 3/2021 Alderman ..... E04D 13/17

* cited by examiner

ROOFING SYSTEM

FIELD OF THE INVENTION

The present invention relates generally to roofing systems, more specifically but not by way of limitation, a metal roofing system that is configured to be superposed an existing metal rood wherein the present invention includes components that facilitates coupling the new roof to existing purlins.

BACKGROUND

Millions of structures both commercial and residential have metal roofs installed thereon. Metal roofs are installed due to their long lifespan and durability. Metal roofs are most commonly manufactured from galvanized metal and aluminum panels and include the appropriate support structure and configuration to facilitate securing the roof to a building. As is known in the art, a typical roofing structure will include main frame rafters wherein the main frame rafters have secured thereto a plurality of purlins. The purlins are oriented such that they are perpendicular to the main frame rafters and extend completely across the roof. The purlins provide several key functions wherein a first is to provide support for the roof that will be superposed thereon. Additionally, the purlins tie the main frame rafters together which provides stability and strength to the structures framing. Lastly, purlins add additional support between the spans of the individual framing bays.

While metal roofs do last a long time, ultimately they must be replaced which offers many challenges to those responsible for the task. Replacing a roof can be quite costly wherein one of the significant costs is removing the old roof. Removal of the old roof cannot only be expensive but undesirable in certain climates. Additionally, removal of the original roof can sometimes result in damage to the structure or an uncovering of damage which may lead to greater repairs. While composition material roofs are often overlaid each other, it is not normal practice to superpose a new metal roof over an existing metal roof on a structure. One of the reasons it is not common practice to overlay a new metal roof over an existing metal roof is that existing metal roof components do not have the elements that facilitates securing the new metal roof directly to the purlin nor do new metal roofs lie properly over existing metal roofs.

Accordingly, there is a need for a metal roofing system that includes the necessary components that facilitates the ability for a new metal roof to be overlaid on an existing metal roof wherein the new metal roof is configured to be directly secured to the purlins of the structure.

SUMMARY OF THE INVENTION

It is the object of the present invention to provide a metal roofing system that is configured to be superposed an existing metal roof wherein the present invention includes support spacing members wherein the spacing members are placed so as to axially align with roof purlins on the structure.

Another object of the present invention is to provide a roofing system that is configured to be overlaid an existing roofing system wherein the support spacing members include a center portion having leg members on opposing sides thereof that provide an elevated orientation of the center portion.

A further object of the present invention is to provide a metal roofing system that is configured to be superposed an existing metal roof wherein the present invention includes a plurality of metal panels configured to be superposed the support spacing members.

Still another object of the present invention is to provide a roofing system that is configured to be overlaid an existing roofing system wherein the present invention further includes a longitudinal clip member that is operable to seam together adjacent metal panels.

An additional object of the present invention is to provide a metal roofing system that is configured to be superposed an existing metal roof wherein the support spacing members are placed across the width of the entire structure.

Yet a further object of the present invention is to provide a roofing system that is configured to be overlaid an existing roofing system wherein the longitudinal clip member includes three contiguous portions forming a void between the first portion and third portion operable to engage a portion of the roof panel therein.

Another object of the present invention is to a provide a metal roofing system that is configured to be superposed an existing metal roof wherein the roof panels of the present invention are approximately fourteen to eighteen inches in width and include longitudinal edge members configured to be coupled to the longitudinal clip member.

An alternate object of the present invention is to provide a roofing system that is configured to be overlaid an existing roofing system wherein in a preferred embodiment the elements of the present invention are manufactured from materials such as but not limited to galvanized steel or aluminum.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
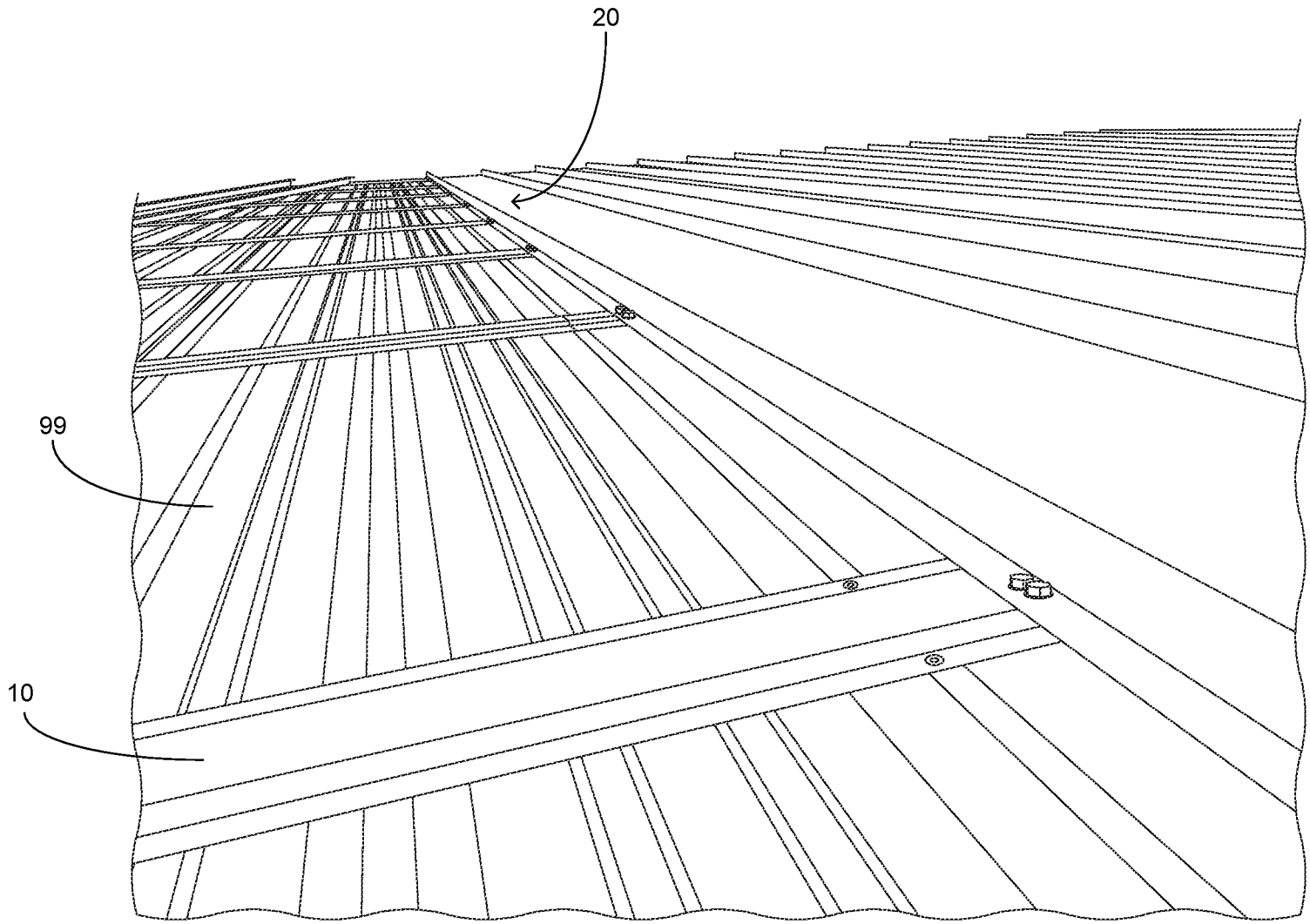
FIG. 1 is a perspective view of the present invention being installed over an existing roof.
Figure 2:
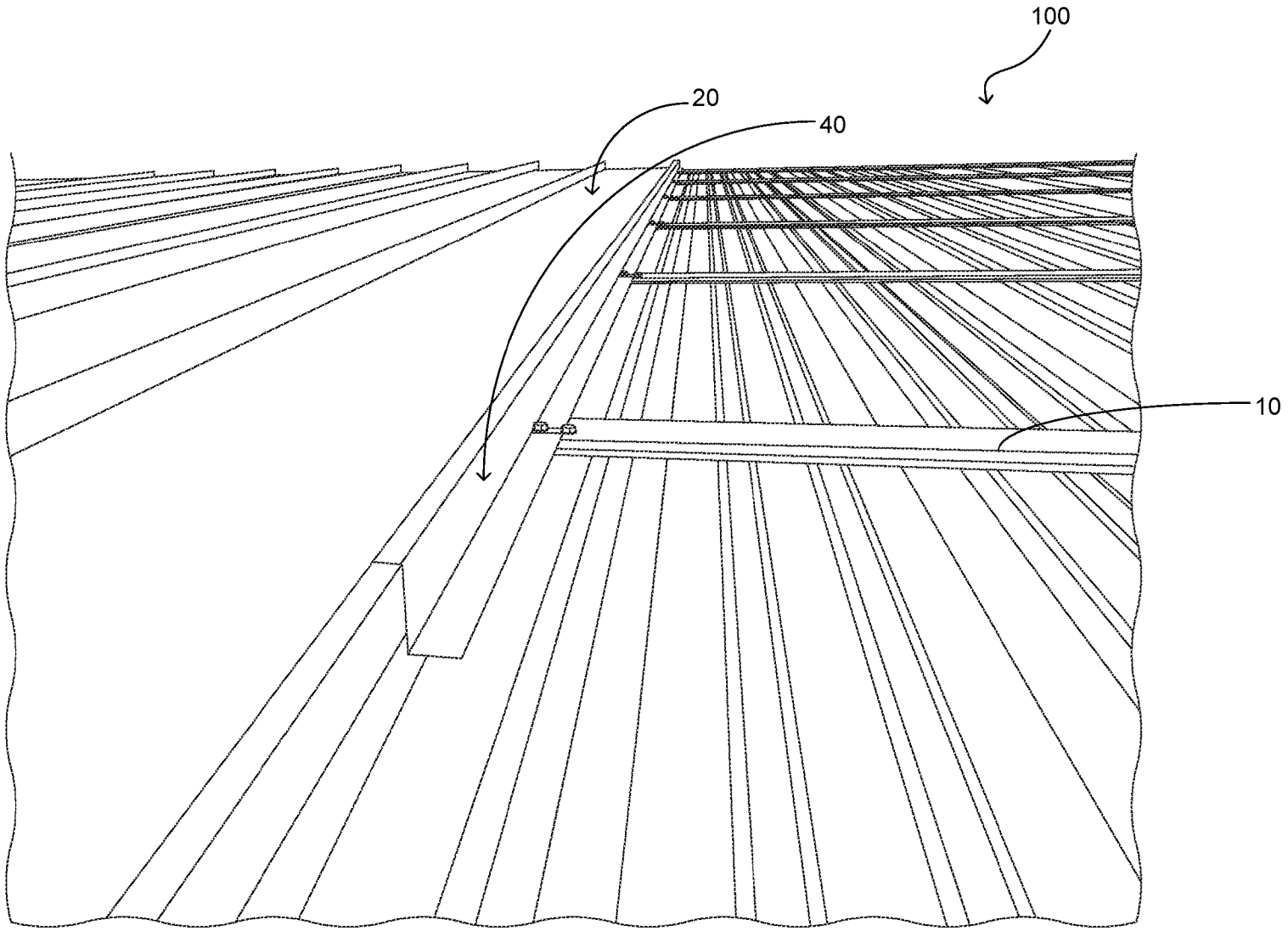
FIG. 2 is a detailed view of the present invention with the longitudinal fastener engaged with a longitudinal edge of a roof panel member.
Figure 3:
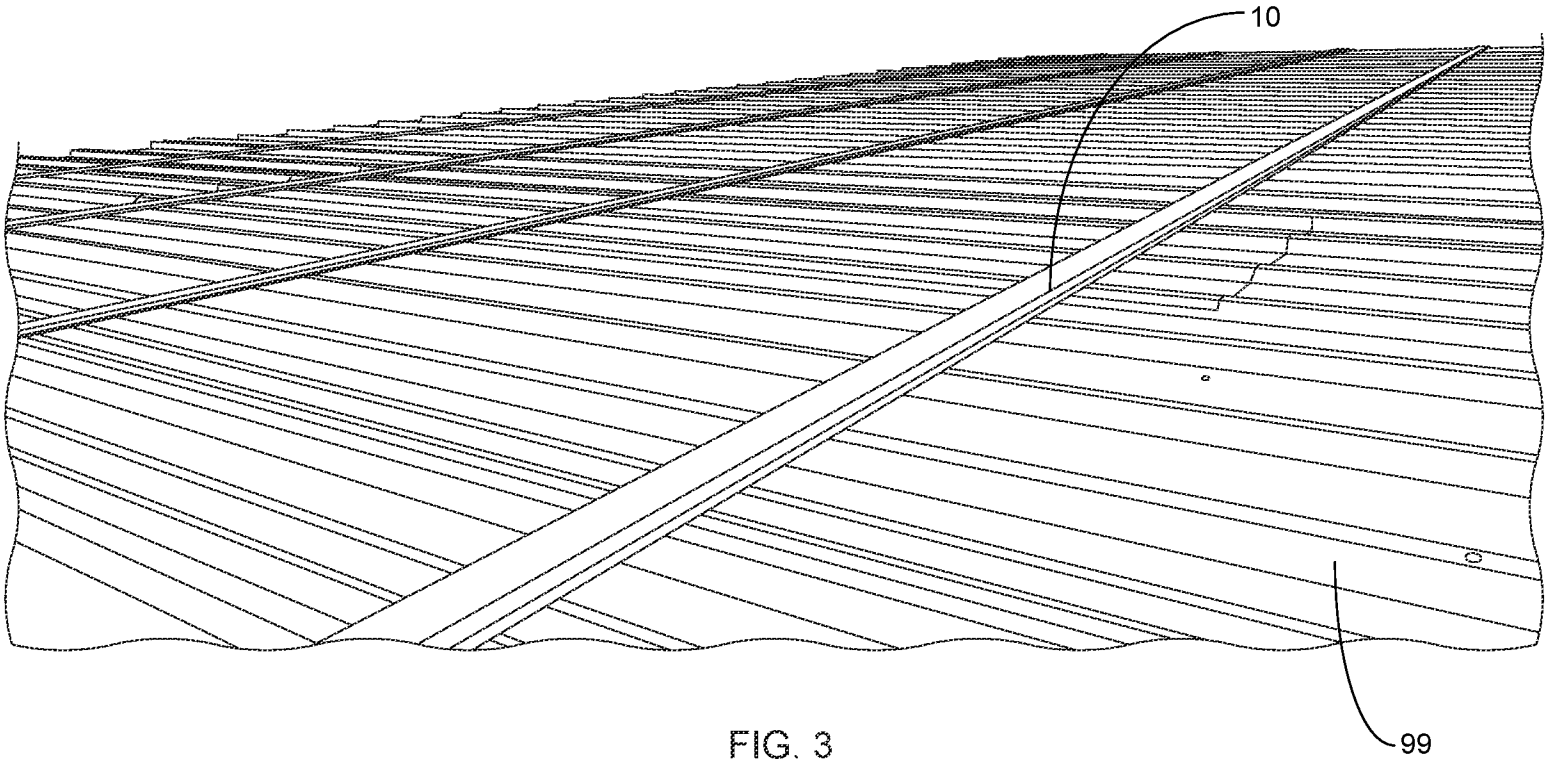
FIG. 3 is a perspective view of the support spacing members installed on an existing roof.
Figure 4:
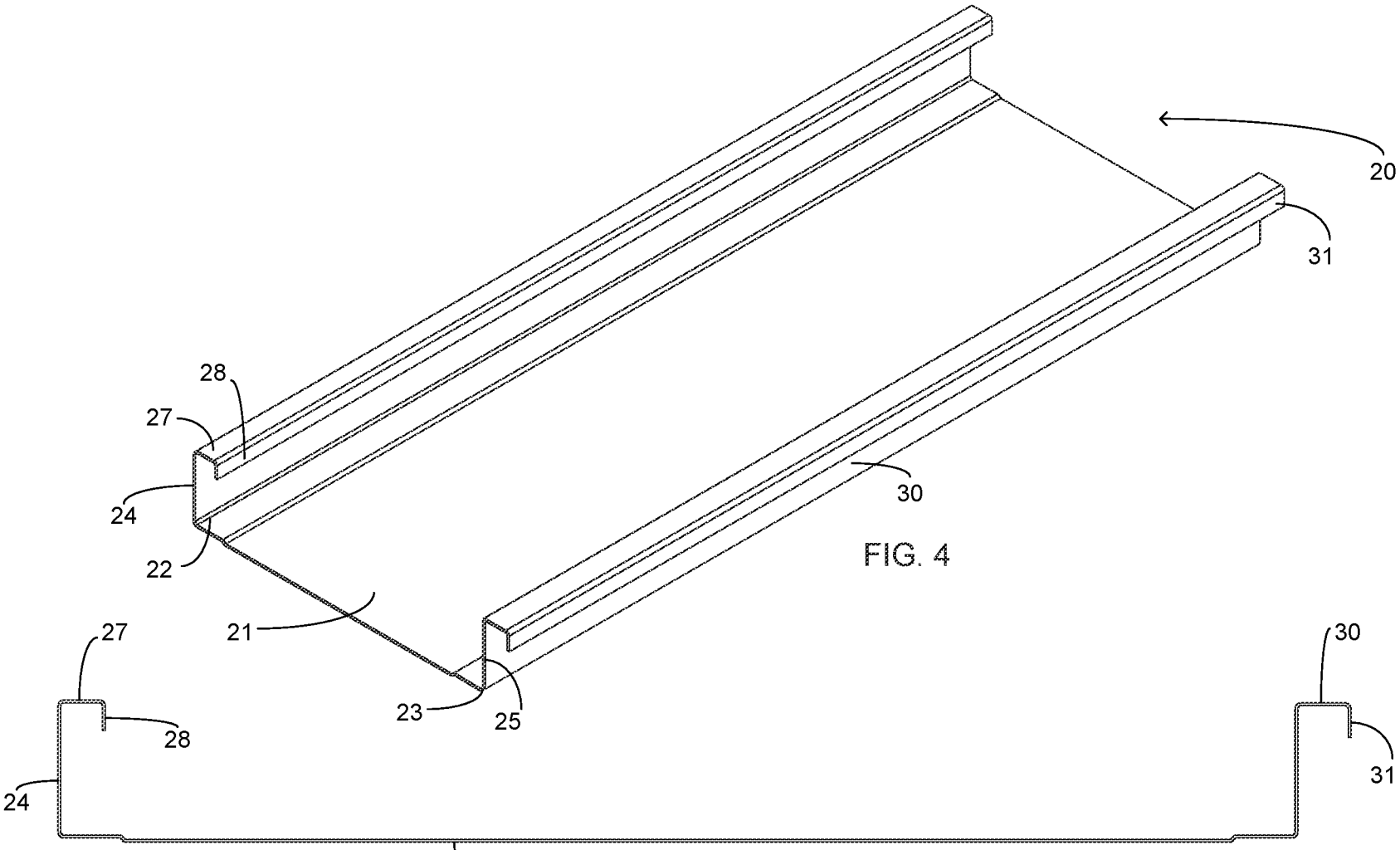
FIG. 4 is a perspective view of a roof panel member of the present invention.
Figure 5:
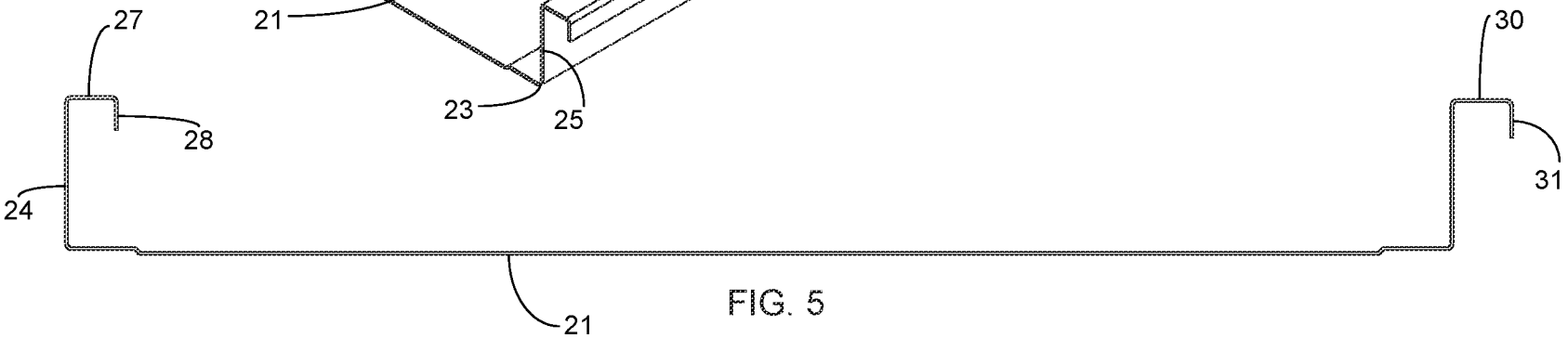
FIG. 5 is a cross sectional view of a roof panel member of the present invention.
Figure 6:
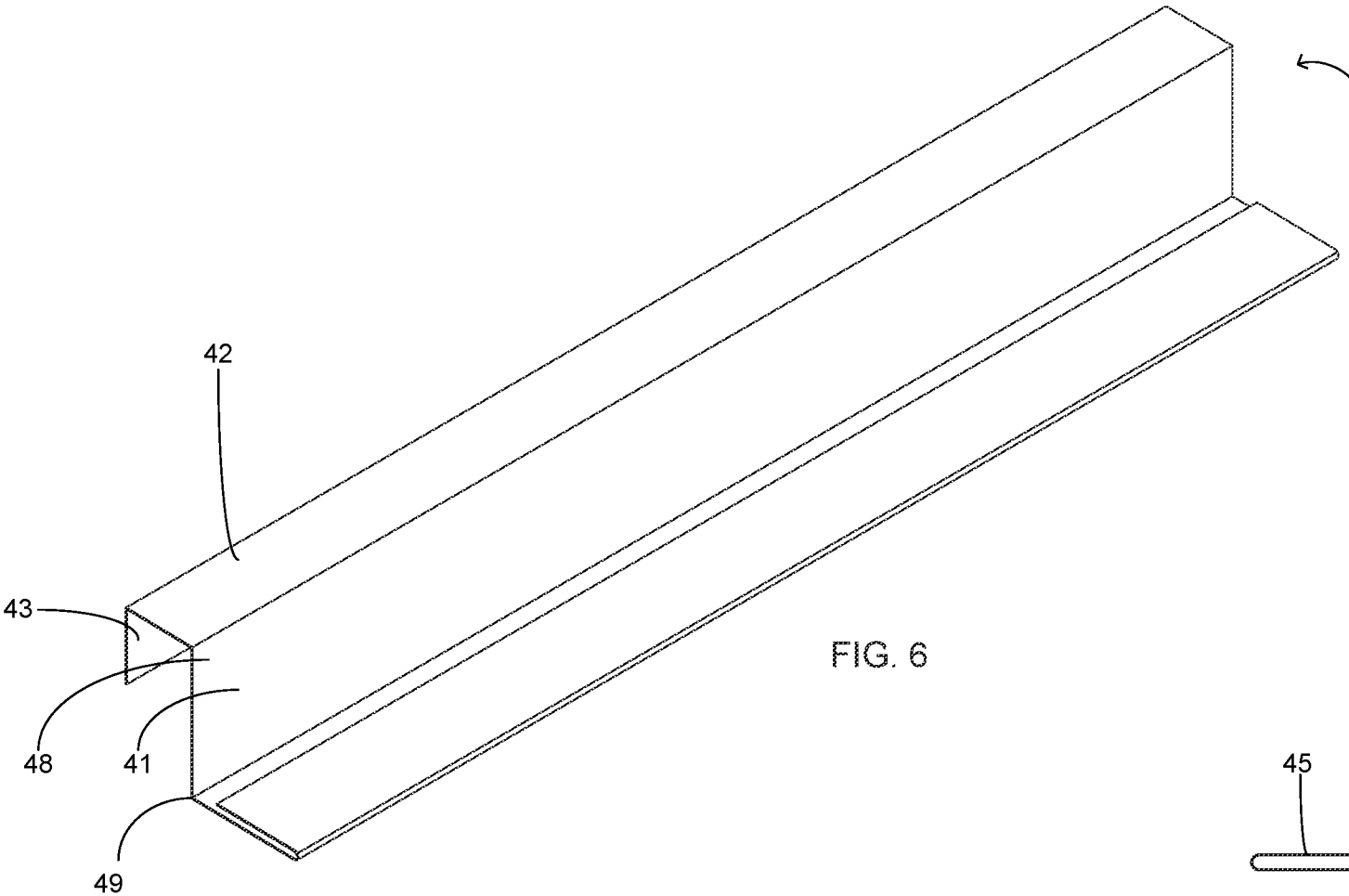
FIG. 6 is a perspective view of the longitudinal clip member of the present invention.
Figure 7:
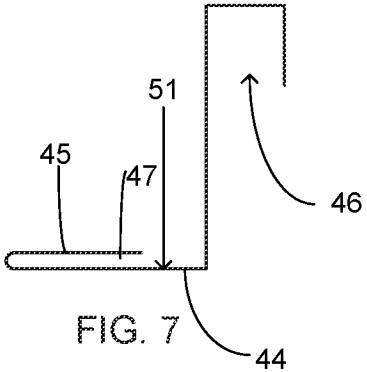
FIG. 7 is a cross sectional view of the longitudinal clip member of the present invention.
Figure 8:
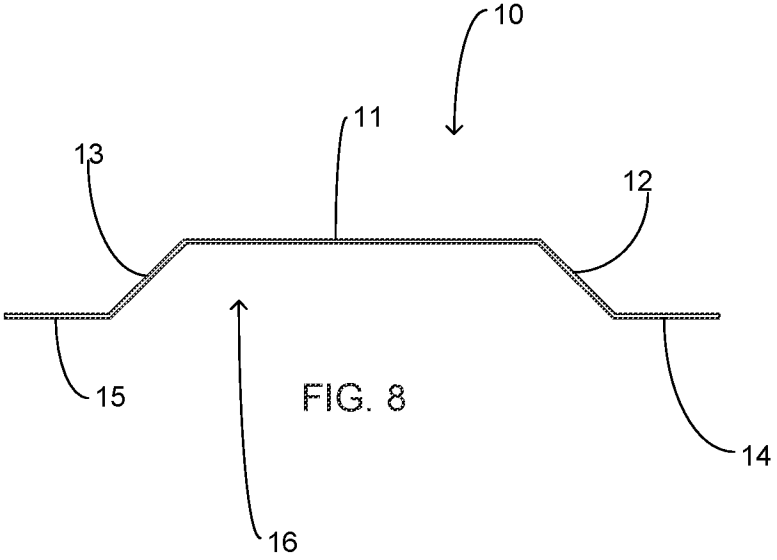
FIG. 8 is a cross sectional view of a support spacing member of the present invention.

Referring now to the drawings submitted herewith, wherein various elements depicted therein are not necessarily drawn to scale and wherein through the views and figures like elements are referenced with identical reference numerals, there is illustrated a roofing system 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Now referring in particular to the Figures submitted herewith, the roofing system 100 is configured to be superposed an existing roof 99. In the preferred embodiment of the present invention the roofing system 100 is overlaid an existing metal roof but it should be understood within the present invention that the roofing system 100 could be overlaid alternate types of roofs. Furthermore, it should be understood within the scope of the present invention that the roofing system 100 could be installed on numerous types of structures to include but not be limited to commercial or residential structures.

The roofing system 100 includes a plurality of support spacing members 10. The support spacing members 10 are manufactured from materials such as but not limited to galvanized steel or aluminum or other suitable material. The support spacing members 10 are elongated in shape and are positioned on the existing roof 99 so as to be axially aligned with the purlins of the structure on which the roofing system 100 is being installed. Axial alignment of the support spacing members 10 with the purlins provides the ability for the support spacing members 10 to be mechanically secured directly to the purlin and as such provide the desired strength and wind rating for the roofing system 100. The support spacing member 10 includes a center portion 11 wherein the center portion has longitudinal brace edges 12, 13 on opposing sides thereof and are angular in orientation therewith.

The longitudinal brace edges have contiguously formed therewith edge portions 14, 15. The structural formation of the contiguously formed longitudinal brace edges 12,13 and edge portion 14, 15 provide a void 16 underneath the center portion 11 that will elevate the roofing system 100. This elevation of the roofing system 100 provided by the support spacing member 10 facilitates the proper flat orientation of the roof panel members 20 once installed over the existing roof 99. The existing roof 99 is shaped and has a height so the support spacing members 10 facilitate the roof panel members 20 of the roofing system 100 to lay flat and be properly secured an installed. The support spacing members 10 are mechanically secured to purlins of the structure on which the roofing system 100 is being installed utilizing screws or other suitable mechanical fasteners. While no particular height for the void 16 is required, good results have been achieved utilizing longitudinal brace edges 12, 13 that are at least three quarters of an inch in order to create the desired elevation of the center portion 11. The height of the center portion 11 does not exceed three inches as this is all that is required to achieve the desired objective discussed herein. It should be understood within the scope of the present invention that the support spacing member 10 could be manufactured in various lengths and heights depending on the structure to which the roofing system 100 is being installed.

The roof panel member 20 is elongated and rectangular in shape being manufactured from galvanized steel or aluminum or similar durable material. The roof panel member 20 includes center section 21 that is planar in manner having opposing longitudinal edges 22, 23. A first vertical support member 24 is contiguously formed with longitudinal edge 22 and a second vertical support member 25 is contiguously formed with longitudinal edge 23. The first vertical support member 24 and second vertical support member 25 are perpendicular to center section 21 and extend upward therefrom. The first vertical support member 24 includes a first upper support member 27 and a second upper support member 28 that are contiguously formed. The first upper support member 27 is perpendicular to the first vertical support member 24 and extends inwards towards center section 21. The second upper support member 28 is perpendicular with the first upper support member 27 and extends downward towards the center section 21. Similarly, the second vertical support member 25 includes a first upper support member 30 that is perpendicular thereto and extends away from the center section 21. The first upper support member 30 has contiguously formed therewith a second upper support member 31 that is perpendicular thereto and extends downward therefrom. The aforementioned elements are formed in the illustrated and described formation in order to facilitate coupling with the longitudinal clip member 40 that is further discussed herein. While a preferred structure of the roof panel member 20 is illustrated and discussed herein, it is contemplated within the scope of the present invention that the roof panel member 20 could be provided in alternate forms and achieve the desired objective discussed herein. The roof panel member 20 has a preferred width of fourteen to eighteen inches and a height of two inches but it is contemplated within the scope of the present invention that the roof panel member 20 could be provided in alternate widths and heights. Furthermore, it should be understood within the scope of the present invention that the roof panel member 20 could be provided in a plurality of alternate lengths.

The longitudinal clip member 40 is operable to mechanically couple adjacent roof panel members 20. Ensuing placement of a roof panel member 20 a longitudinal clip member 40 is placed adjacent thereto and functions to secure a subsequent roof panel member 20. The longitudinal clip member 40 is formed to have a shape that mateably couples with the roof panel member 20 and is crimped utilizing suitable tools so as to provide coupling thereof. It should be understood within the scope of the present invention that while preferred shapes are discussed and illustrated herein that alternate shapes of the longitudinal clip member 40 could be provided in order to mateably couple with a roof panel member 20 and achieve the desired coupling thereof.

The longitudinal clip member 40 includes center vertical support member 41. The center vertical support member 41 includes an upper edge 48 and a lower edge 49. Contiguously formed with the center vertical support member 41 proximate the upper edge 48 is upper support member 42. The upper support member 42 is perpendicular to the center vertical support member 41 and extends outward therefrom. Contiguously formed with the upper support member 42 distal to the upper edge 48 is outward support member 43. The outward support member 43 is perpendicular to the upper support member 42 and extends downward therefrom. The formation of the upper support member 42 and outward support member 43 creates void 46 wherein the void is present intermediate the center vertical support member 41 and the outward support member 43. Contiguously formed with the center vertical support member 41 proximate the lower edge 49 is the lower support member 44. The lower support member 44 is planar in manner and extends outward from the center vertical support member 41 being perpendicular thereto. A portion 45 of the lower support member 44 is formed therewith and oriented back towards the center vertical support member 41 forming a void 47 intermediate the lower support member upper surface 51 and the portion 45. While no particular height is required for the longitudinal clip member 40 is required, good results have been achieved employing a height of two and one-sixteenth of an inch.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding description is, therefore, not intended to be limited to the specific forms set forth herein, but on the contrary, it is intended to cover such alternatives, modifications, and equivalents, as can be reasonably included within the spirit and scope of the invention.

What is claimed is:

1. A roofing system configured to be secured to a building having an existing roof wherein the roofing system overlays the existing roof and the roofing system comprises:

a plurality of support spacing members, said plurality of support spacing members being elongated in form, said plurality of support spacing members having a first end and a second end, said plurality of support spacing members being superposed upon the existing roof and axially aligned with purlins of the building, said plurality of support spacing members having a center portion, said center portion having opposing lateral edges, said opposing lateral edges having longitudinal brace edges contiguously formed therewith, said longitudinal brace edges being angular in orientation with said center portion, said longitudinal brace edges being consistent in form intermediate said first end and said second end, said longitudinal brace edges configured to elevate said center portion so as to create a void between a lower surface of said center portion and an upper surface of the existing roof;

a plurality of roof panel members, said plurality of roof panel members being elongated in form, said plurality of roof panel members having a center section that is planar in manner, said center section having a first longitudinal edge and a second longitudinal edge on opposing sides of said center section, said first longitudinal edge having a first vertical support member contiguously formed therewith being perpendicular to said center section and extending upward therefrom, said second longitudinal edge having a second vertical support member contiguously formed therewith being perpendicular thereto and extending upward therefrom, said plurality of roof panel members having a first end and a second end; and a plurality of longitudinal clip members, said plurality of longitudinal clip members having a center vertical support member, said center vertical support member having an upper edge and a lower edge, said center vertical support member having an upper support member contiguously formed with the upper edge thereof, said upper support member being perpendicular to said center vertical support member and extending outward therefrom, said plurality of longitudinal clip members further having an outward support member, said outward support member being contiguously formed with said upper support member distal to said center vertical support member, said outward support member being perpendicular to said upper support member and extending downward therefrom, said plurality of longitudinal clip members having contiguously formed with the center vertical support member proximate the lower edge a lower support member, said lower support member being planar in manner and extending outward from the center vertical support member being perpendicular thereto, said lower support member further having a portion being superposed over the lower support member wherein a void is present intermediate the lower support member and said portion, said portion being parallel with said lower support member, said portion being contiguously formed with said lower support member and extending towards the center vertical support member, said plurality of longitudinal clip members operable to mateably couple to the plurality of roof panel members and provide operable joining thereof.

2. The roofing system configured to be secured to a building having an existing roof as recited in claim 1, wherein said plurality of roof panel members further include a first upper support member, said first upper support member being contiguous with said first vertical support member and perpendicular therewith.

3. The roofing system configured to be secured to a building having an existing roof as recited in claim 2, wherein said first upper support member extends inward towards said center section.

4. The roofing system configured to be secured to a building having an existing roof as recited in claim 3, wherein said plurality of roof members further include a second upper support member, said second upper support member being contiguous with said second vertical support member and perpendicular therewith, said second upper support member extending away from said center section.

5. The roofing system configured to be secured to a building having an existing roof as recited in claim 4, wherein said first upper support member has contiguously formed therewith a third upper support member wherein said third upper support member is perpendicular to said first upper support member and extends downward therefrom.

6. The roofing system configured to be secured to a building having an existing roof as recited in claim 5, wherein said second upper support member has formed therewith a fourth upper support member, said fourth upper support member being perpendicular to said second upper support member and extending downward therefrom.

7. The roofing system configured to be secured to a building having an existing roof as recited in claim 6, wherein said plurality of longitudinal clip members include a void intermediate said outward support member and said center vertical support member.

8. The roofing system configured to be secured to a building having an existing roof as recited in claim 7, wherein said plurality of longitudinal clip members further include a lower support member, said lower support member being contiguous with said lower edge of said center vertical support member and extending outward therefrom being perpendicular thereto.

* * * * *